United States Patent [19]

Couche et al.

[11] Patent Number: 4,551,886

[45] Date of Patent: Nov. 12, 1985

[54] OYSTER-OPENING TOOL

[76] Inventors: Léon Couche, 25 c, rue du Pommerot, 25150 Pond De Roide; Daniel Lacourt, 41, allée de la libération, 57100 Thionville; Roger Ventavoli, 17, rue de Gaulle, 57440 Algrange, all of France

[21] Appl. No.: 497,641

[22] Filed: May 24, 1983

[51] Int. Cl.[4] ..... A22C 29/04

[52] U.S. Cl. ..... 17/75

[58] Field of Search ..... 17/74, 75, 76

[56] References Cited

U.S. PATENT DOCUMENTS

| | | | |
|---|---|---|---|
| 1,472,179 | 10/1923 | Lofland | 17/75 X |
| 1,974,766 | 9/1935 | Budreaux . | |
| 1,990,424 | 2/1935 | Briasco . | |
| 3,886,628 | 6/1975 | Berry . | |

FOREIGN PATENT DOCUMENTS

| | | |
|---|---|---|
| 599224 | 1/1926 | France . |
| 827277 | 4/1938 | France . |
| 1464856 | 1/1967 | France . |
| 1579646 | 8/1969 | France . |

OTHER PUBLICATIONS

Publication Excerpt "Quincaillerie Moderne"-article by Y. G. Papillon-Le Couteau a huitres des Etablissements German.

Search Report for French Application 81 22 120, listing all of the above.

*Primary Examiner*—Willie G. Abercrombie

*Attorney, Agent, or Firm*—Karl F. Ross; Herbert Dubno

[57] ABSTRACT

The utensil provided by the invention comprises an elongated handle having at one end a working head comprising an end-piece in the form of a tapering beak, pointed and upwardly curved, for dislocating and separating the valves through the heel of the shell, and an element for severing the muscle formed by a blade retractable into the handle, assisted by a return spring and sliding in a plane passing between the base and the point of the end-piece. A projection, provided for bearing against the hand holding the oyster and for serving as a guard, is formed from two prongs having the same form as the profile of the end-piece.

8 Claims, 23 Drawing Figures

OYSTER-OPENING TOOL

FIELD OF THE INVENTION

The present invention relates to the opening of oysters or other similar bivalve mollusks, with a view to their consumption.

BACKGROUND OF THE INVENTION

In what follows reference will be made for the sake of convenience to oysters, it being however understood that the invention is not limited to this example, but applies to any bivalve mollusk, such as clams, scallops, etc . . . . By this expression is meant any shellfish formed by an edible body enclosed in a shell having two valves which are closely applied one against the other. In the case of oysters, the valves are hinged together at one end, called the "heel", by means of a ligament hinge and are held closed by a powerful muscle which connects them together at a position slightly off-centered in direction from the opposite end to the heel and offset to the right, the oyster being seen from above.

Any operation for opening oysters, for consuming them, requires severing the retaining muscle. For this, oyster openers generally use a small knife with a sharp blade. This instrument is practically inefficient and even dangerous when it is used for the same purpose by an occasional operator such as the consumer.

The blade is forced into the joint between the valves in the vicinity of the muscle while a force is exerted on the knife in the direction of the oyster, so also in the direction of the hand which holds it. Accidents usually occur at that moment, when the blade slips on the shell following an error in detecting the joint, which can only be discerned with difficulty by an unpracticed eye because of the very undulating appearance of the laminations of the shell at the position considered.

Known oyster-openers intended for the general public, and some of which are widely available commercially, aim more or less at improving the protection afforded to the operator but not one gives real satisfaction.

They may be roughly classed in two categories depending on the method chosen for penetrating the shell by means of a cutting member for severing the muscle.

Instruments of the first category, derived from the previously mentioned knife, aim at dislocating and then separating the valves by means of a blade which is forced into the joint so as to reach the muscle.

Among these we find current commercial utensils, such as knives with a wide and pointed blade, having, at right angles to the working end of the handle, a guard for protecting against slipping of the blade on the shell. In fact, this guard only protects the hand which holds the blade and which in any case only risks being scratched by coming into contact with the shell, as opposed to the other hand which, holding the oyster, is directly exposed to the blade of the knife.

The use of a protecting glove for the hand holding the oyster has also been thought of. But the inevitable rigidity of the glove penalizes the ease of the opening operation in favor of safety of the operator which remains however limited.

Instruments of the second category proceed, not by separating the valves, but by removing a portion of the shell so as to form therein an opening through which a cutting element is then inserted so as to cut the muscle. Removal of material may be made either by cutting the end opposite the heel by means of cutting pincers (French patent application No. 1 536 939), or by removing a small disk from the upper flat valve in the immediate vicinity of the muscle by means of a tubular punch in which slides a wire cutting by rotation (French patent application Nos. 2 173 803 and 2 383 635).

In addition to the disadvantages related to the operating difficulties or to the appearance of oysters opened under such conditions, these devices do not seem capable of ensuring the indispensable cleanliness of the edible body because of shell waste or fragments which make it unclean and even dangerous to eat.

A device is further known common to the above-mentioned categories in that it works by dislocating and separating the valves in the vicinity of the muscle by means of a penetrating member, separate from the element for severing the muscle.

This device, described in French patent application No. 1 464 856, is formed of a handle equipped with a working head provided with a short blade disposed beside a conical motor driven borer. As the instrument is brought closer to the oyster, the borer gradually separates the valves during introduction thereof, while the blade, set slightly back, severs the muscle.

In fact, this instrument cumulates in a certain way the respective disadvantages of the two above-mentioned categories:

Indeed, the difficulties of initially positioning the point of the borer in the joint and the consequences thereof often unfortunate for the operator remain in their entirety.

Moreover, the rotating borer which penetrates inside the oyster may take with it fragments torn from the edges of the valves and, similarly, break up the edible body, thus making it unfit for consumption, or at least unfit to comply with the criteria of presentation of the oyster demanded by consumers.

Moreover, the motor of the borer, as well as the transmission members are placed inside the handle, so that this latter forms more a protective case than a gripping handle adapted to comply with the ergonomic requirements of a handle.

We can then see, through this brief analysis of the state of the art, that the "oyster-opening" utensils intended for the general public show a real incapacity for providing correctly and conjointly the contradictory requirements which are the ease of opening of the shell, the safety of the operator and the presentation of the oyster, not only from the aesthetic point of view but also from the point of view of cleanliness of the edible body.

OBJECTS OF THE INVENTION

An object of the present invention is precisely to reach a better compromise between all these contradictory requirements.

Another object is to provide a robust, reliable construction of simple design and of low cost price.

Yet another object is to make available to inexperienced persons a means for opening oysters which is easy to handle, and associated with a simple operating method.

SUMMARY OF THE INVENTION

The invention provides a utensil for opening oysters, or other similar bivalve mollusks, comprising an elongate gripping handle equipped at one end with a working head comprising, on the one hand, a member for dislocating and separating the valves by the heel of the shell formed by an end-piece having a base inset in the handle and a free part whose end is tapered and pointed and, on the other hand, an element for severing the muscle formed by a cutting member, such as a blade, retractable into the handle and sliding, at least at the location of the end-piece, at a level situated between the base and the pointed end thereof.

In accordance with a preferred embodiment, the free part of the end-piece presents in profile a curved upwardly directed shape.

Preferably, the pointed end of this free part is bent towards the horizontal.

According to an advantageous embodiment, the free part at least presents, in section, a concave shape.

According to another arrangement of the utensil, the blade is assisted by a return spring exerting a force which tends to hold it retracted in the handle, said spring being housed in a pusher provided on the blade.

As will doubtlessly be readily understood, the invention is based on the idea of opening the oyster according to an original operating method, in which two distinct means participate, coming into action one after the other to ensure respectively and chronologically the dislocation and the separation of the valves and then severing of the retaining muscle.

Contrary to the above-mentioned rotary borer device, the dislocating and separating member is fixed whereas the severing means is movable longitudinally in translation.

The operating method, for which the utensil of the invention has been specially designed, consists in dislocating the oyster by its heel and not penetrating therein laterally in the vicinity of the muscle, as a first approach to the problem would logically suggest and as most of the known solutions furthermore recommend.

The inventors have in fact realized that the heel, despite the apparent robustness of the oyster at this position, forms in fact the most vulnerable point of the shell because of the existence, at the level of the hinge connecting the valves, of a natural slit necessary for its proper operation.

The tapered shape of the end of the end-piece has been specially designed to be able to pass through this slit and engage without appreciable effort in the joint by destroying the ligaments at least partially.

The desired separation is then provided by a simple and easy rocking movement of the handle up and down with respect to the oyster and, into the opening thus provided, the blade extends from the handle and severs the muscle while passing between the point and the base of the end-piece.

The blade must be both sufficiently long to be able to reach the muscle from the heel and sufficiently short, so as not to obstruct engagement of the end-piece in the slit of the heel.

In fact, these two requirements are only apparently contradictory since severing of the muscle only takes place as an end phase after dislocation of the heel, so that a retractable blade seems perfectly appropriate.

Moreover, it is advantageous to make this blade slidable in the handle, since this latter, being dimensioned so as to provide a good grip for the operator, presents a length largely compatible with even a large travelling distance of the blade. Moreover, such an arrangement allows the operator to adjust the useful travel of the blade depending on requirements, with respect to the size of the oyster to be opened.

On the other hand, the upward curve of the free part of the end-piece, in accordance with an advantageous feature of the invention, is provided, among other things, so that the blade, when passing between the point and the base of the end-piece, readily penetrates into the oyster between the valves held apart by the end-piece and reaches the muscle at a height which depends on the degree of rocking of the handle suring dislocation of the heel.

It will be seen in greater detail hereafter how this curvature of the end-piece or tongue further improves the conditions of use of the utensil by ensuring more especially locking thereof in the shell after dislocation of the heel.

Moreover, in accordance with a preferred variation, the pointed valve-separating tongue or end-piece has a concave shape in cross section. Such an arrangement facilitates penetration because of the half-circle shape which characterizes the slit at the location of the hinge ligaments of the valves.

Furthermore, the concavity of the end-piece, as well as its curvature, contribute to reinforcing its mechanical strength, which must necessarily be of a high quality, for the end-piece, since it acts as a lever during separation of the valves, is then subjected to relatively high bending stresses.

Accessorily, the concavity allows the end-piece to serve as a receptacle in which are collected the different particles of rubbish and dirt inevitably present in the hinge slit of the oyster.

It will be noted that the end-piece in accordance with the invention is a means for dislocating and separating the valves which, contrary to the known means (particularly the above-mentioned rotary borer) do not penetrate inside the oyster but remain at the periphery of the cavity housing the edible body.

Thus, this latter is neither soiled nor damaged and remains then in an irreproachable state of cleanliness and presentation.

It must be emphasized that the utensil of the invention used in accordance with the operating method which is closely associated therewith, is of a nature to allow oysters to be opened under optimum conditions of ease, safety and cleanliness.

In accordance with another preferred embodiment of the invention, the working head also has a projection into the extension of the handle, either on the end-piece side or on the other (depending on whether the utensil is intended for a right-handed or a left-handed person) or more advantageously still on both sides. Preferably, this projection extends parallel to the end-piece.

This projection is provided for bearing against the palm of the hand holding the oyster and thus providing the operator both with great accuracy in handling during the phase of engaging the end-piece in the slit of the heel and total mastery of the force to be exerted.

It further forms an efficient protection guard which gives a feeling of security. It is however not easy to describe in further detail this particular original and attractive aspect of the oyster-opener of the invention. However, the operator will fully appreciate this by himself when he first uses the utensil, for he will be led naturally to use the projection, as indicated above, so as to be able to perfectly control his manoeuver.

BRIEF DESCRIPTION OF THE DRAWING

The invention will in any case be better understood and other aspects and advantages will appear clearly from the following description, given by way of example, with reference to the accompanying drawing in which.

SPECIFIC DESCRIPTION

Figure 1A:
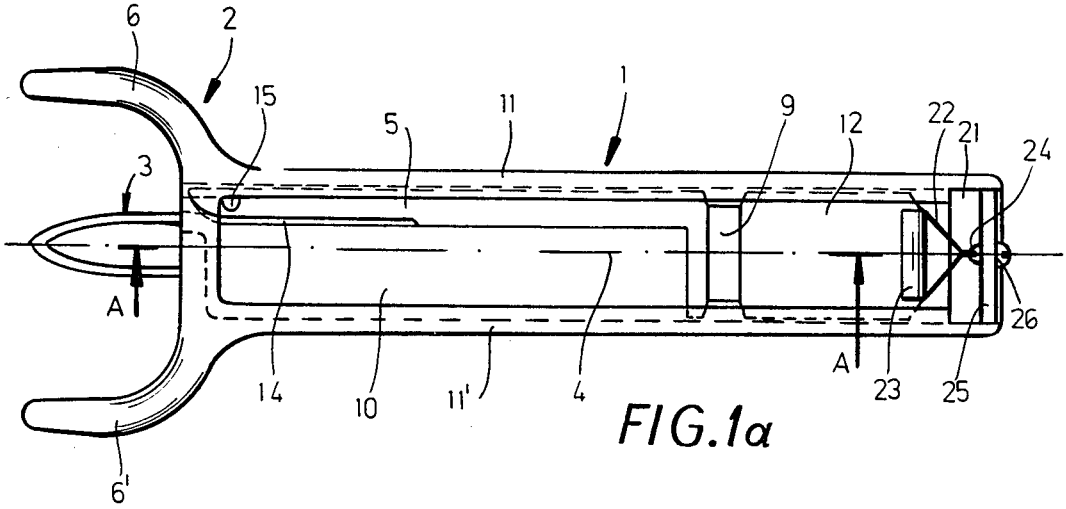
FIGS. 1*a* and 1*b* are top views of the utensil, according to one embodiment of the invention and showing respectively the blade in a retracted position and in the completely extended position.

Reference will be made first of all to FIGS. 1*a*–1*f* illustrating a first embodiment.

The complete description which will be made thereof will allow the description of the other variations to be limited to their special aspects which differentiate them from each other or with respect to this first variation.

The oyster-opening utensil of the invention comprises a straight elongate handle 1 sufficiently thick to give a good manual grip. This handle is equipped at one end with a working head 2 for opening the shell.

The working head is provided with: a metal end-piece 3 centered on the axis of the handle, shown symbolically at 4; a blade 5 retractable into the handle and slightly offset to the right of the end-piece (when looking at the utensil from above); a transverse lower tongue 7 slightly set back and a projection in the extension of the handle formed of two prongs 6 and 6' on each side of the end-piece.

Each of these elements will be described separately.

Valve-separating tongue or end-piece 3, concave in shape, is firmly anchored in the handle by its base 3A. Its free part 3B, curved upwardly and tapering to its pointed end 3C, confers thereon a general shape ressembling that of a beak.

The two side prongs 6 and 6' extend the handle forwardly while deviating from each other at their base by a distance at least equal to the width of the heel of the shell so as to be able to engage the working head thereabout so as to allow introduction of the end-piece. These prongs are also upwardly curved following the curvature of end-piece 3 (FIG. 1*d*) so that this latter does not extend beyond the limits of the volume defined by the prongs therebetween. Their end is moreover rounded so as to bear, one or the other, against the hand holding the oyster while allowing a sustained pressure without risk of being hurt.

With these arrangements, as will have been doubtless understood, this projection 6,6' has a secondary function as protection guard enveloping end-piece 3.

Thus designed, without penalizing the visibility of the operator, this guard allows the point of the end-piece to be "masked" so that any injury to the hand holding the oyster is practically excluded, even supposing that the end-piece may slip on the shell following a handling error.

It should moreover be noted that the curvature of the end-piece also contributes to limiting the risks of injury. This curved shape is, consequently, in itself an accessory protection means which advantageously completes the purely functional character of the end-piece.

The lower transverse tongue 7 has been provided as guard for protecting the hand holding the handle. It further defines with a second tongue 8 provided at the other end of the handle, a position for the hand of the operator under optimum gripping and safety conditions.

Blade 5 is actuated by a pusher 9 sliding on the upper part of the handle hollowed out for this purpose.

In the example considered, the pusher is formed by a simple bend in blade 5. This latter is visible from the top and slides flat on the bottom of a wide and shallow recessed passage 10, whose flanges 11, 11' advantageously serve as guide ramps for the thumb of the hand which drives the pusher.

The blade is extended at the rear of the pusher by a widened zone 12 whose edges, engaging in grooves 13, 13' formed for this purpose at the base of flanges 11, 11', provide both guiding in translational movement of the mobile assembly and maintenance thereof in position in the bottom of passage 10.

Furthermore, the blade is provided with a cutting edge 14 on the inner edge only so as to reduce the risks of injury. For the same purpose, its end is rounded. This latter also comprises on its upper face a small boss 15, the use of which will be explained subsequently with reference to FIG. 2. It should be observed that, seen from above, blade 5 may be offset to the right or to the left of end-piece 3. However in the case of oysters, the offset to the right is preferable for the blade may then more readily reach the muscle retaining the valves which is situated precisely on this side.

In so far as the relative position in height is concerned it has already been mentioned that the blade must slide at least in the vicinity of the end-piece at a level passing between base 3A of the end-piece and its point 3C. Preferably, for reasons which will also be better understood with reference to FIG. 2, the blade slides at about 1 cm below point 3C. This arrangement is illustrated in FIG. 1*c*, where it can be seen that an aperture 16, provided in the working end 2 for passing blade 5 there-through, is remote from the point of the end-piece by a distance, designated "h", of about 1 cm.

Figure 1D:
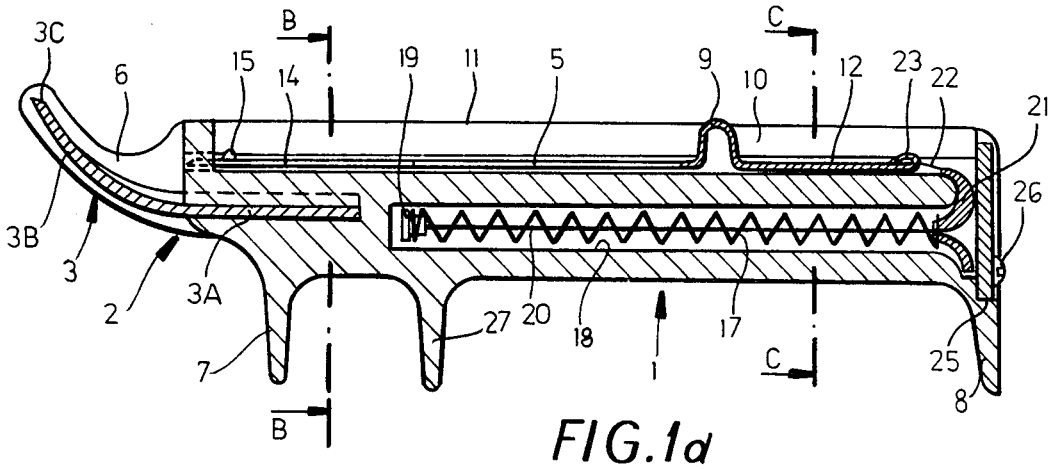
FIG. 1*d* is an axial longitudinal sectional view along plane AA of FIG. 1*a;*
Figure 1C:
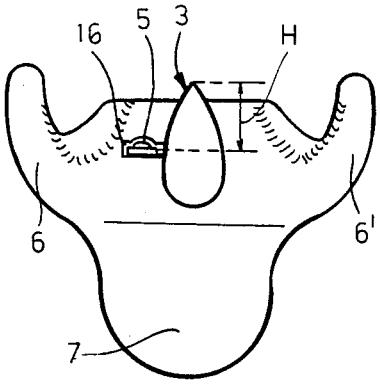
FIG. 1*c* is a front view of the working head of the utensil shown in FIG. 1*a;*
Figure 1E:
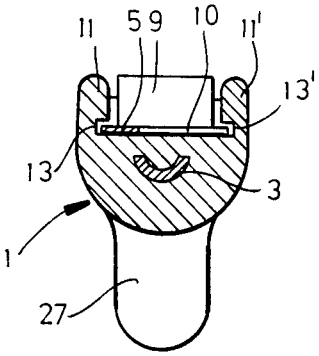
FIGS. 1*e* and 1*f* are cross sections through planes BB and CC respectively of FIG. 1*d;*
Figure 1F:
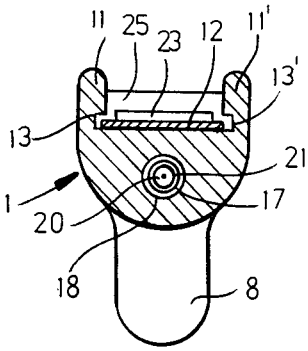
Figure 1B:
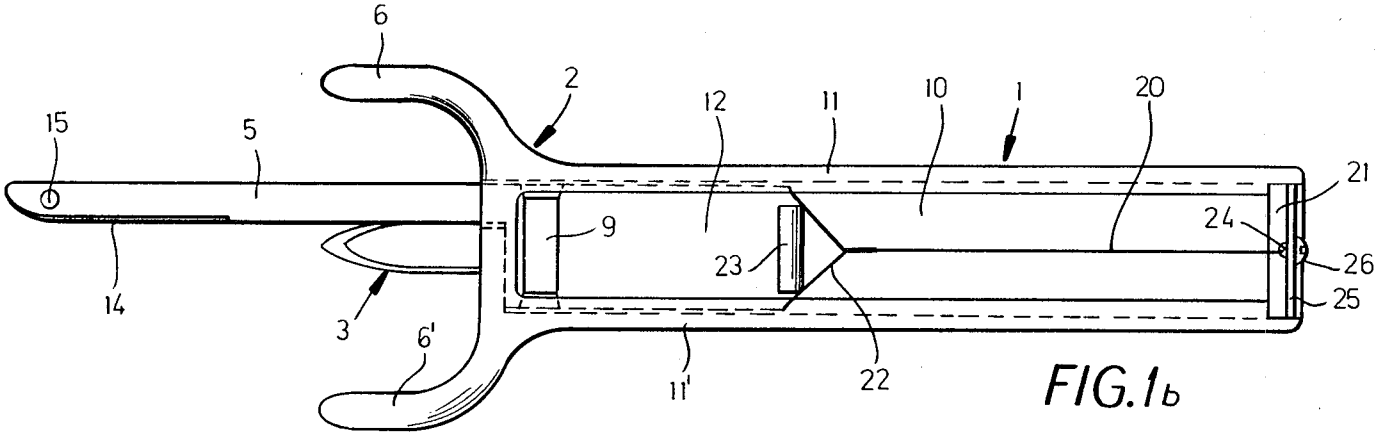

Reference will now be made more precisely to FIGS. 1*d* and 1*f*.

It can be seen in these figures that blade 5 is assisted by a return spring 17 which tends to maintain it retracted inside handle 1. This spring, of a "helical" type, is housed in a blind longitudinal cavity 18 formed in the body of the handle and which extends as far as the immediate vicinity of the base 3A of the end-piece.

As can be seen, the spring 17 is under compression in a direction opposite the extending direction of blade 5. For this, the spring is urged by a small disk 19 connected to blade 5 by a control wire 20 which passes axially through the spring while passing through the opening of cavity 18 at the rear of the handle.

The spring is in fixed abutment against a piece 21, in the shape of a funnel, inserted in the opening of cavity 18. This funnel has a central passage aligned with the axis of spring 17 for centering wire 20. This latter is joined to the rear end of zone 12 of the blade while following the profile of the internal surface of the funnel whose shape is determined for giving to the wire a curvature which prevents any jamming and thus provides correct operation of the blade.

The wire may be fixed to zone 12 by an appropriate means. The example considered shows fixing by means of a loop (FIGS. 1*a* and 1*b*) engaged in the curved end 23 of zone 12.

Furthermore, a groove 24 for housing and guiding the wire is provided on the funnel 21 and a closure plate 25 is applied at the rear of the handle against funnel 21. Fixing of the plate is provided by a screw 26.

Thus, when the blade extends, disk 19 compresses spring 17 and the energy thus stored is used subsequently for returning blade 5 automatically into the handle.

It should also be understood that the presence of return spring 17 is explained by the desire to provide a maximum of convenience for the operator.

The "safety" aspect does not come in here, since the blade could only be dangerous at the moment of dislocating the valves. Now, at that time, blade 5 is necessarily retracted so that end-piece 3 can be introduced into the heel of the oyster.

It will finally be noted that a third lower tongue 27 is provided in the vicinity of guard 7 and the face thereof opposite this latter serves advantageously for retaining the forefinger of the hand holding the handle when the thumb actuates pusher 9.

The method of using the utensil will now be described with reference to FIG. 2, which will bring out other advantageous aspects of the invention.

There is shown schematically at 28 a hollow oyster seen in longitudinal vertical section passing through the heel, designated at 29.

At 30 can be seen the upper flat valve, at 31 the lower hollow valve, at 32 the plane of the joint between these valves, at 33 the ligament hinge at the hingeing point of the shell and at 34 the retaining muscle. The edible body has not been shown so as not to needlessly overload the figures.

As was mentioned at the beginning, the heel of the oyster forms a privileged approach point for the joint of the valves presents at this position a natural slit 35 offering free access to the ligament hinge 33.

At the beginning of the operation, the oyster to be opened is held flat in one hand, the hollow valve 31 being in contact with the palm and the heel 29 being directed in the opposite direction from the thumb. The utensil of the invention is held in the other hand, the working head being of course directed towards the oyster.

Figure 2A:
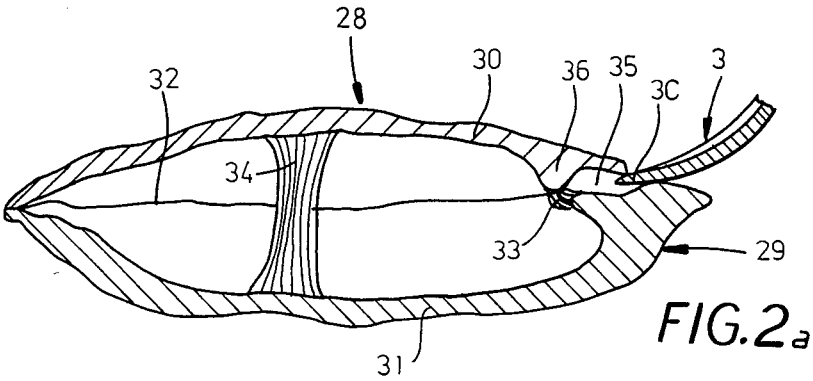
FIGS. 2*a*, 2*b* and 2*c* illustrate the operating method of the utensil for opening oysters.

Then the pointed end 3C of end-piece 3 is inserted into slit 35 of the heel in the position shown in FIG. 2*a*.

In some cases, the slit may be locally narrowed by an operculum due to a surface growth of the upper valve. But it is easy to remove this operculum with point 3C of the end-piece which is then inserted in the freed passage.

Figure 2B:
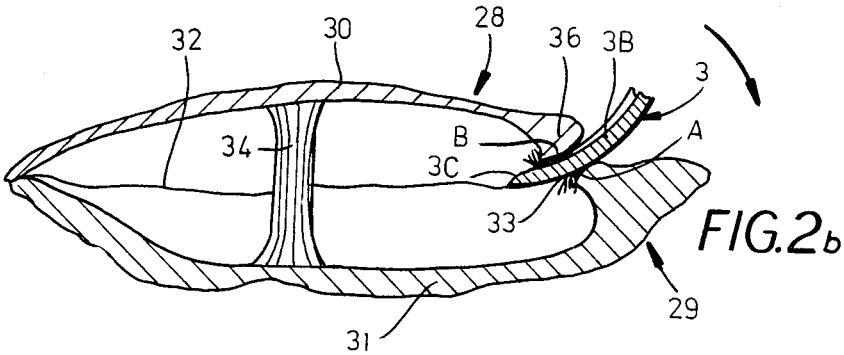

By exerting a thrust on the handle of the utensil, and slightly rocking it or turning it at the same time, it is possible without difficulty and without great effort to insert the end of the end-piece inside the oyster through ligaments 33, which are then severed, as shown schematically in FIG. 2*b*.

The ease of the operation at this stage is obtained because of the fineness of point 3C of the end-piece.

This ease is further improved if portion 3B of the end-piece, which widens out after the point, in concave, for it then has the shape of the half circle profile of the slit at the junction of the valves. These structural features, which may be perfectly well seen by observing an open oyster, have not been shown so as to avoid overloading the figures.

Figure 2C:
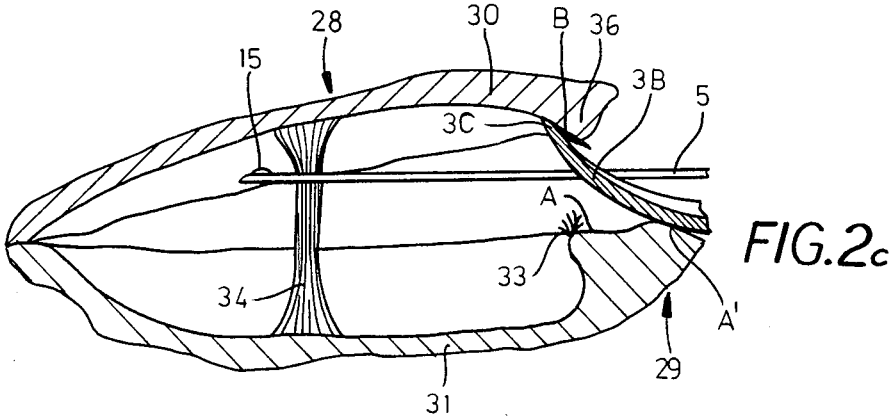

Then the dislocation of the heel is completed by rocking the handle downwards, which results, as shown in FIG. 2*c*, in raising the upper valve 30 and thus forming an opening sufficiently large to let blade 5 extend from the handle and reach the vicinity of the muscle 34. This latter is then cut by causing the utensil to pivot slightly horizontally.

As can be seen, the opening operation with the oyster-opener of the invention is extremely simple.

In addition to the advantages already mentioned, the following features should be emphasized:

Dislocation of heel 29 by the curved end-piece 3 engaged in slit 35 is greatly facilitated because of the abundance of material at the end of the hollow valve 31 and which, as shown in the figures, projects with respect to the end of the upper valve 30.

This projection forms a fulcrum for the end-piece which may thus be handled like a lever in a particularly efficient way.

Although not obligatory, the curved shape of the end-piece presents nevertheless a determining interest since the end-piece forms in this case a lever with evolutive action, perfectly adapted to the differentiated requirements which appear during the operation of dislocating and separating the valves.

In fact, at the beginning (FIG. 2*b*) the end-piece bears on the lower shell 31 at a point A very close to the lifting point B on the upper shell 30.

Then, during the rocking movement of the handle, such as indicated by the arrow, the fulcrum runs along the contact generatrix of the end-piece and is stabilized at A' at the end of the projection of the heel (FIG. 2*c*).

Thus, there is available at the beginning of the operation a maximum lever effect, precisely when it is a question of overcoming a maximum resistance of the oyster resulting from the joint effect of the retaining muscle 34, the sticking of the valves in the plane of joint 32 and the residual traction of the non severed filaments 33.

Then, by progressively increasing the lever arm BA, a separating effect is provided which is gradually amplified, precisely when it is desired to form a sufficient opening for inserting the blade and when the oyster only opposes a resistance limited to that of muscle 34 which is more and more distended.

Furthermore, because of the curved shape of its end, the end-piece, during insertion thereof, is adapted to the shape of a swelling 36 on the upper valve to which ligaments 33 are fixed and which ensures hingeing of the shell in cooperation with a corresponding cup (not shown) on the lower valve.

During separation, point 3C of the end-piece gradually takes up a position behind this swelling (FIG. 2*c*), which then serves as a locking stop preventing any possible escape of the utensil.

Furthermore, since this swelling must not prevent the blade 5 from passing, it will be readily understood that this latter must slide at a level situated below that of point 3C of the end-piece.

The minimum offset to be respected depends of course on the size of the swelling, but experience shows that an offset of the order of 1 cm is suitable in practice in all cases.

Blade 5 thus passes in the vicinity of swelling 36 and boss 15 provided at its end ensures, if need be, sliding thereof over the internal wall of the upper valve.

It will be understood that the opening thus takes place in an extremely advantageous way since, on the one hand, the blade hardly touches the edible body of the oyster and, on the other hand, severs muscle 34 at its upper part by means of a simple deflecting movement along the horizontal, which may be repeated several times in succession if required.

Thus, the whole of the edible substance is recovered and the presentation thereof is perfect from the aesthetical point of view.

Figure 3B:
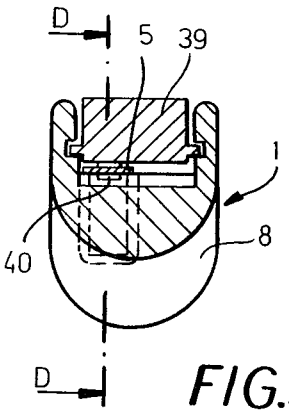
FIG. 3*b* is a cross section through plane EE of FIG. 3*a;*
Figure 3A:
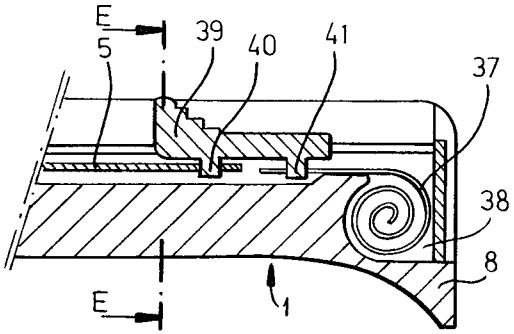
FIG. 3*a* is a partial longitudinal sectional view through plane DD of FIG. 3*b* and showing the rear end of the utensil in an embodiment different from those of FIG. 1.

The second embodiment of the invention, illustrated in FIGS. 3 *a* and 3*b*, consists in replacing the compression spring 17 by a traction spring of the "spiral" wound strip type with floating axis housed in a chamber 38 formed at the free end of handle 1.

The pusher of the blade, shown at 39, is this time an added piece.

It provides at the same time the mechanical connection between the blade and the spring.

To this end, pusher 39 comprises two lower studs 40 and 41 against which are respectively engaged the end of blade 5 and the end of spring 37 provided with openings for this purpose.

This variation has the advantage of minimizing the space occupied by the spring, so that it becomes possible to embed the base of the end-piece in handle 1 as deeply as desired.

Moreover, the choice of a spring of the "wound strip" type has the advantage of maintaining substantially constant the force to be exerted on the pusher during extension of the blade.

Figure 4A:
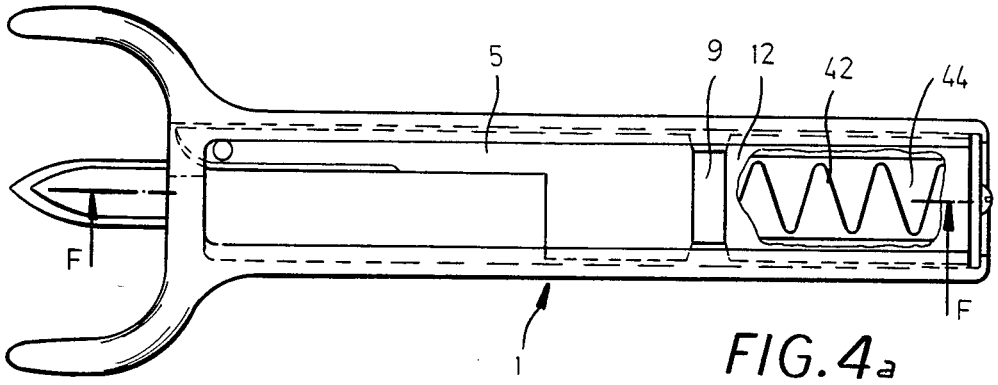
FIG. 4*a* is a top view with parts cut away of a third embodiment.
Figure 4B:
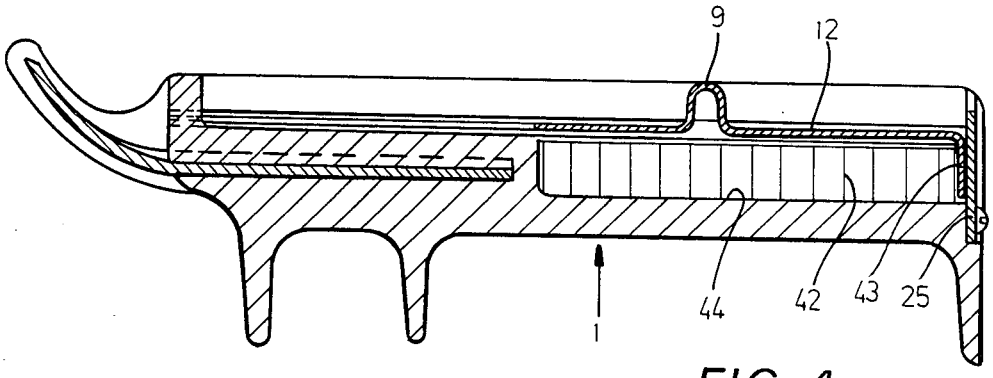
FIG. 4*b* is a longitudinal axial sectional view through plane FF of FIG. 4*a;*

A third variation, illustrated in FIG. 4, consists in using a compression spring 42 of the "accordion blade" type.

The mechanical connection with blade 5 is provided by a bearing surface 43 formed by bending at right angles the end of the rear zone 12 and which, in the rest state, abuts against the closure plate 25.

Contrary to the variation shown in FIG. 1, the spring is here urged under compression in the same direction as that of the extending direction of the blade and its housing 44 open at the top occupies practically all the rear half of the volume of the handle.

Such a variation provides the same advantage as in the case of the wound strip spring in so far as the uniformity of the force to be exerted on pusher 9 is concerned.

Figure 5:
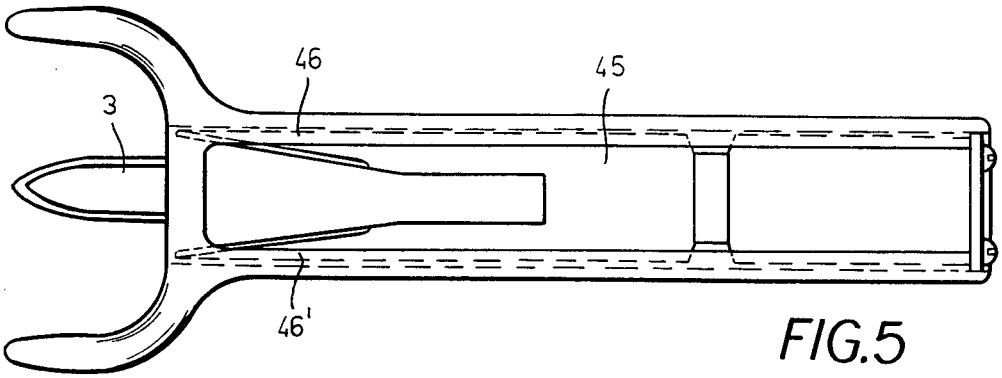
FIG. 5 shows, seen from above, a utensil in accordance with a variation with a two pronged blade.
Figure 6A:
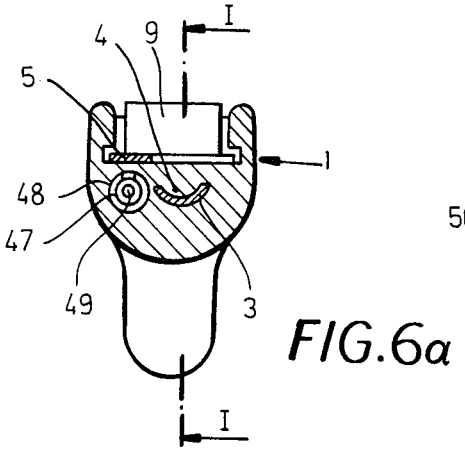
FIGS. 6*a* and 6*b* are cross sections of a fifth variation of the invention through plane GG of FIG. 6*c* and plane HH of FIG. 6*d* respectively.
Figure 6B:
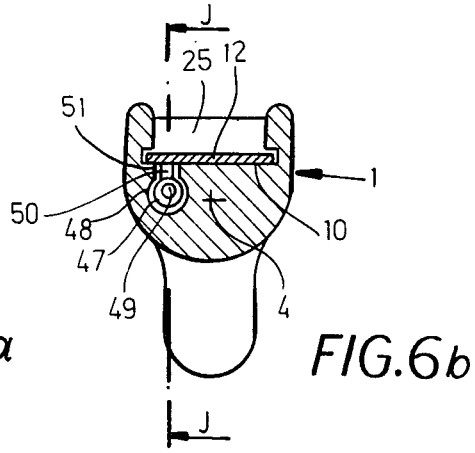
Figure 6C:
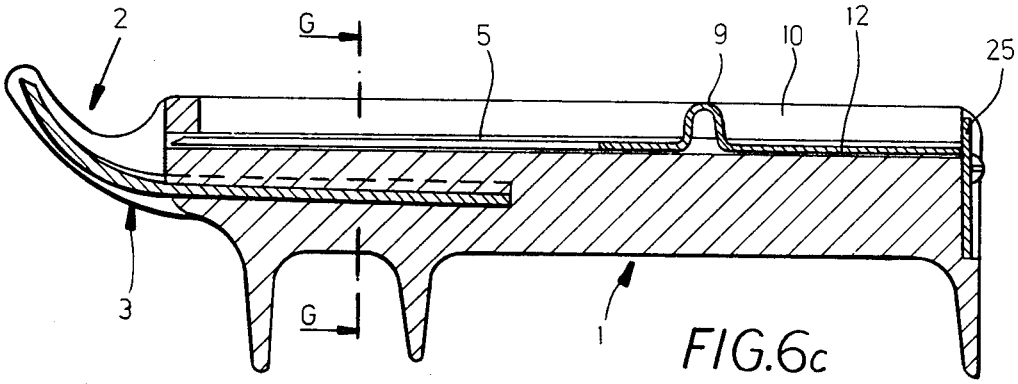
FIGS. 6*c* and 6*d* are longitudinal sectional views through plane II of FIG. 6*a* and plane JJ of FIG. 6*b* respectively.
Figure 6D:
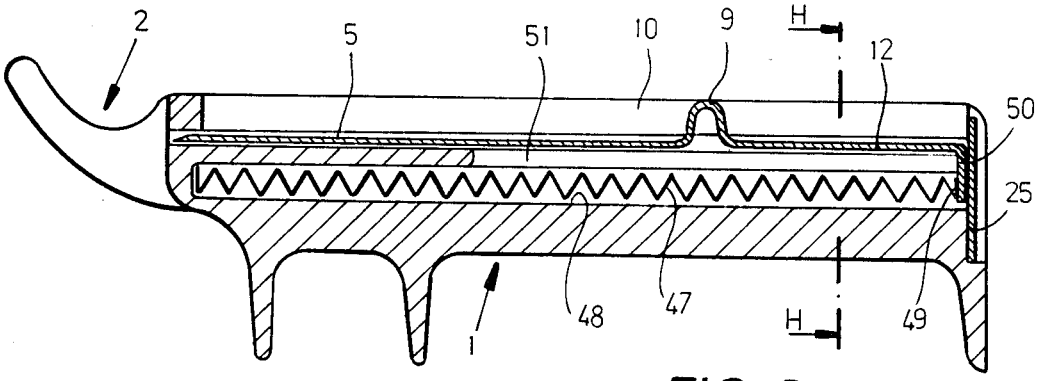

FIG. 5 illustrates a fourth variation which relates this time to a particular construction of the blade for severing the muscle.

This blade, referenced 45, is cut out in a "V" shape whose two cutting legs 46 and 46' slide on each side of end-piece 3.

A blade of this type contributes to facilitating cutting of the muscle.

However, its construction is slightly more complex than the blade 5 seen previously and this aspect may be taken into account in a study of the manufacturing cost.

Nevertheless, the two leg blade 45 may be substituted for blade 5 and may then be applied to all the embodiments which have been described here.

A fifth variation is illustrated in FIGS. 6*a* to 6*d*. The detailed representation which these figures give is explained by the fact that the construction considered seems to correspond to a very competitive manufacturing cost for a utensil providing all the guarantees of reliability and strength.

This variation is characterized essentially by two original features:

- on the one hand, end-piece 3 has been slightly off-centered laterally with respect to the axis 4 of handle 1,
- on the other hand, the return spring 47 used is a helical spring with non jointing turns, similar to the one chosen for the variation of FIG. 1, but it works under compression this time in the same direction as the extending direction of blade 5.

The offset of end-piece 3 provides a greater depth for the housing 48 of the spring, which, as can be seen, may then extend practically over the whole length of the handle.

This feature has the advantage of providing a smooth and practically constant force on the pusher 9 during extension of the blade.

Spring 47 is urged under compression by a disk 49 bearing in the rest position against the closure plate 25 under the effect of the residual pressure of the spring. This disk is connected to the end of zone 12 of blade 5 by a small rod 50 which slides in a slot 51 formed in the bottom of passage 10. The disk and the rod may advantageously be formed by cutting out and bending at right angles the end of the rear zone 12 of the blade.

It will be understood that slot 51 causes the housing of the spring to communicate with the outside. However, this housing is sealed with respect to different dirt and rubbish practically perfectly because of the narrowness of the slot and especially because of its location under blade 5 which thus serves as a lid therefor.

It will be noted that this particular location of the slot under the blade is simply due to the fact that, with end-piece 3 offset laterally on the working end 2, the housing 48 of the spring is positioned by construction under blade 5.

Figure 7:
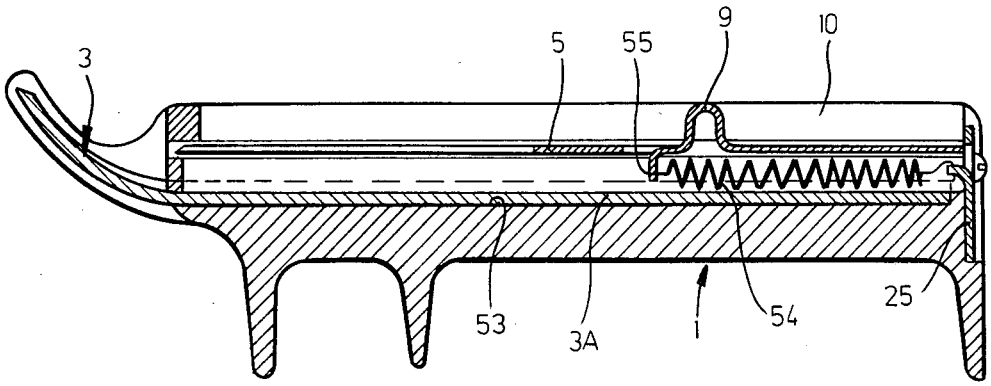
FIGS. 7, 8 and 9*a* each show in longituinal axial section, another embodiment of the device of the invention.

FIG. 7 shows a sixth variation for conciliating a deep anchorage of the end-piece with a return spring extending over the whole length of the handle.

To this end, it is the end-piece 3 itself, or more exactly its base inserted in handle 1, which serves as housing for the spring.

The end-piece is centered on the axis of handle 1 and has a base 3A practically as long as this latter and whose concave U shaped profile is substantially more pronounced than in the previously described examples.

End-piece 3 is firmly anchored in a rectilinear groove 53 provided at the bottom of passage 10 where blade 5 slides, and spring 54 is positioned between the legs of the "U" shaped profile.

With the housing of the spring thus left open at its upper part, the spring 54 chosen in this embodiment is of the "traction" type so as to avoid the risks of undulations which a compression spring would cause in this case. Spring 54 is held fixed at its rear end on closure plate 25. It is urged under traction at its other end by a small tongue 55 punched out from the blade 5 itself, in front of pusher 9.

Figure 8:
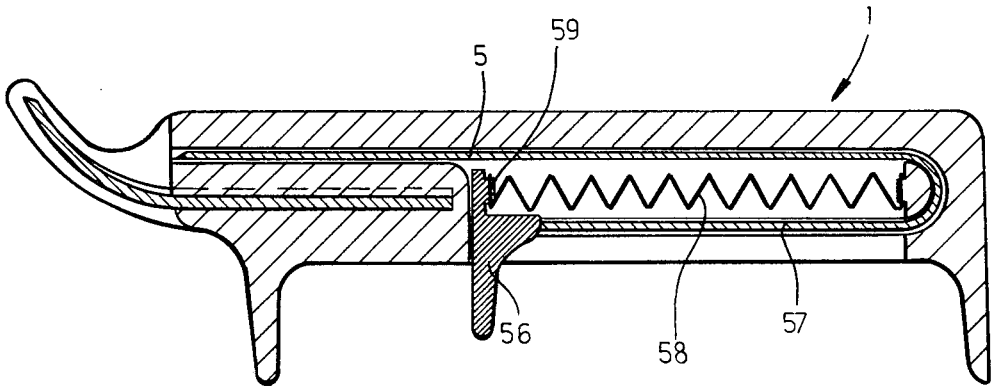

A seventh variation is shown in FIG. 8. Its originality resides in the fact that the tongue on which the forefinger bears at right angles to the lower face of handle 1 (reference 27, FIG. 1) here forms a trigger 56 slidably mounted in the handle and controlling the extension of blade 5.

This latter slides in a recess formed this time under handle 1 and presents, in the vicinity of the lower face thereof, a bent-back portion 57 whose end is fixed to trigger 56. A helical spring with non jointing turns 58 is housed above the bent-back portion 57 and its mobile end bears against a shoulder 59 of the trigger which urges it under compression in the opposite direction to that of the extension of the blade.

Figure 9A:
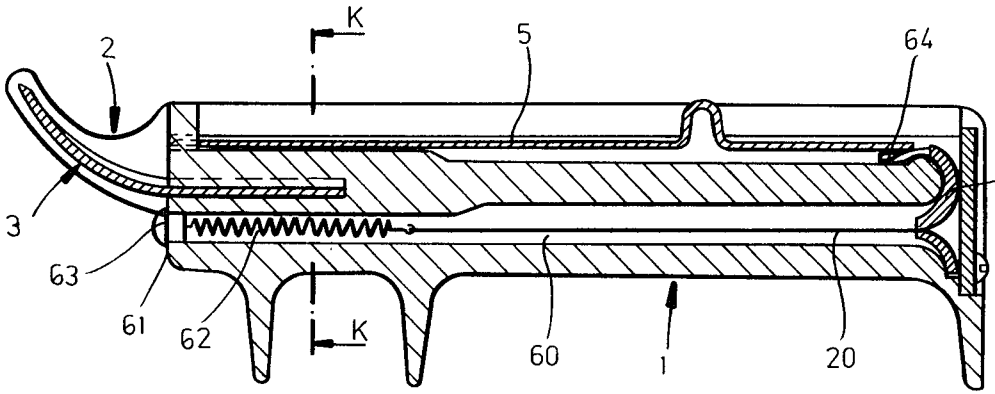
Figure 9B:
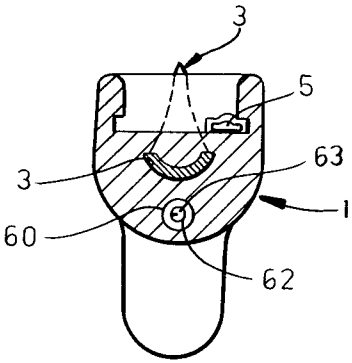
FIG. 9*b* is a cross sectional view through plane KK of FIG. 9*a;*

An eighth variation is shown in FIGS. 9*a* and 9*b*.

This embodiment is based strictly on considerations both functional and constructional.

In the case of a helical spring, whether it works under compression or under traction, it is necessary, taking into account the considerable travel of the blade, to form inside the handle a housing of great depth for the spring.

If the handle is formed by molding—as is advantagesly the case—to obtain the housing for the spring a sliding mandrel of great length is required in the handle.

Thus, a handle 1 such as shown in FIG. 9 is obtained, totally hollowed out axially and in which the recess considered 60 passes at a lower level to that of the positioning of end-piece 3 to open out at the working head 2 hrough an operning 61.

Thus a handle is formed with a minimum of material, easy to produce by mass production methods and in which the housing 60 for the spring complies to a great extent with all the functional requirements related to the travel of the blade.

It is then advantageous to use a traction spring 62 which, contrary to the compression spring of the same type, can be accomodated in a housing 60 of any form not necessarily adapted to the outline of the spring.

As can be seen, spring 62 is fixed at one end to a plug closing opening 61.

Its mobile end is connected to blade 5 in the same way as in the variation shown in FIG. 1, i.e. by means of a wire 20, guided by the funnel 21 inserted in the rear opening of the handle and whose portion inside the housing is of course equal at least to the travel of the blade.

Wire 20 is secured to a small tongue 64 punched out from blade 5.

Figure 10:
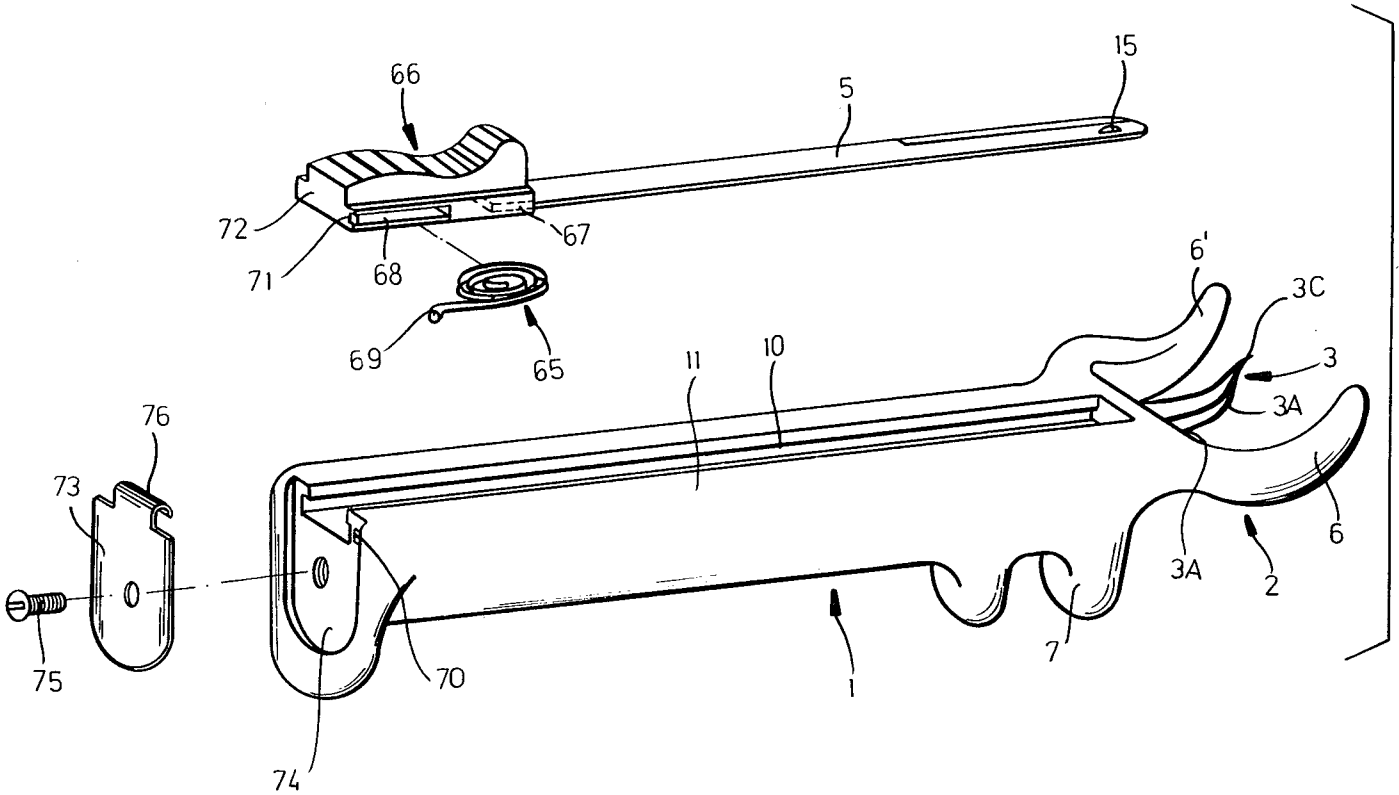
FIG. 10 is a general exploded view of a utensil according to the invention in its preferred embodiment.

The variation shown in FIG. 10 represents the best embodiment which the inventors have been able to construct.

It is characterized by the presence of a return spring 65 in pusher 66 which actuates blade 5.

These three elements are described in detail below.

Pusher 66 has "T" shaped cross section provided for sliding in the passage 10 of the same shape in the upper part of handle 1.

The base of the pusher, which is preferably formed by molding, comprises two cavities: one cavity 67 opening out into the front face and serving as a housing for blade 5, the other, shown at 68, opening out into the lateral face of the base and serving as a housing for spring 65.

The upper face of the pusher has a wavy and fluted ergonomic shape so as to facilitate actuation thereof by the thumb.

The return spring 65 is of the preshaped wound strip spiral type. Its outer end is bent back in the opposite direction to the winding so as to form a small anchoring loop 69 which is housed in a small cavity 70 provided at the rear end of the handle at the base of blank 11 opposite the opening of the housing 68 for the spring.

Spring 65 has a small width and the space it occupies is slightly less than the volume of its housing 68.

Spring 65 is placed flat in its housing, so that its winding axis is vertical. Moreover, its outer endmost part extends in the direction of the rear end of the handle while passing into a small notch 71 provided on the lateral face of the base of the pusher, and connecting the rear face 72 of this latter to housing 68.

Thus, the spring unwinds while remaining practically invisible, the unwound strip part being pressed naturally and without buckling against the lateral wall of the base of passage 10.

Blade 5 for severing the muscle has advantageously a small width over the whole of its length. Since its rear end is embedded in cavity 67, it may comprise sawtooth notches for example, for perfect locking thereof.

It is fixed by a force-fit and/or by bonding.

It may also be interlocked with pusher 66 during molding, with the overmolding technique.

A closure plate 73 is provided to close off the rear end of the handle by being positioned in a centering undercut portion 74. The plate is secured by a screw 75 engaged in the material of the handle.

As can be seen, plate 73 has at its upper end a narrow portion 76 bent forwardly.

This part 76 forms a loop which, accomodated at the end of passage 10, serves as a stop for pusher 66 and avoids more especially any risk of injury.

It will be readily understood that this variation presents numerous advantages, not only from the practical and aesthetical point of view but also from the functional point of view. It will in particular be noted that the number of component parts is reduced. The assembly thereof, which is effected in the same way as a constructional game, is rapid so inexpensive.

It goes without saying that other variations may be envisaged without departing from the scope of the invention such as defined in the accompanying claims.

Thus, in particular, the shape of projection 6,6' at the working head which may vary over a wide range of structural possibilities to the extent that it forms an intermediate means of contact between the hand holding the handle and the hand holding the oyster while allowing purchase on this latter during the insertion of the end-piece into the heel and, accessorily, to the extent where no tapered so dangerous part of the end-piece (particularly point 3C) projects beyond the limits of the volume generated by this projection.

The two prong structure 6,6′ has been chosen in the examples described for it fulfils this dual role both functional and protective with a minimum of material while remaining aesthetic and preserving a maximum of visibility for the operator.

Similarly, the blade and the end-piece do not necessarily appear side by side on the working head. A utensil in accordance with the invention may in fact be formed in which the blade and the end-piece are superimposed, in which case the blade passes through the end-piece through a horizontal slit formed in this latter. It should however be noted that with a construction of this type, the blade may carry with it inside the oyster rubbish accumulated in the concavity of the end-piece during the initial phase of dislocating the heel.

On the other hand, as already mentioned, the handle may be easily formed by molding a plastic material. The different fixed projecting parts on the body of the handle, other than the end-piece, may be advantageously molded during manufacture and from the same material as the handle. The insertion of the end of the end-piece may then be readily achieved by the technique of overmolding.

Furthermore, manufacture of the handle may be further simplified. For example, the longitudinal grooves at the base of the blanks on the upper face of the handle and in which the edges of the blade are engaged may be suppressed.

It is however preferable to keep them in the case of the variations described with reference to FIGS. 4 and 10. In fact, for the other variations shown, these grooves are especially intended for restraining the blade to prevent it leaving the handle through the top.

In fact, it may be considered that this function is already implicitly ensured by the cooperation of other means, namely the passing slit formed in the working head, which cooperates in this respect either with the disk controlling the spring coming into abutment against the wall of the housing of the spring (FIG. 6), or with the connecting wire (FIGS. 1, 9) which, under the permanent action of the spring, exerts on the blade a force having a vertical component which maintains it urged against the bottom of its sliding passage.

Furthermore, multiple arrangements or improvements may be made to the embodiments described with reference to the figures.

In this respect, the inventors have realized that it might be advantageous to bend towards the horizontal the pointed end 3C of the curved end-piece 3, as can be clearly seen in FIG. 10.

This arrangement in fact allows a more natural penetration of the oyster for the operator because of the possibility offered of slanting the handle with respect to the horizontal less than in the case of a completely curved end-piece (FIG. *2a*).

Similarly, the concavity which the end-piece advantageously presents may not extend as far as point 3C.

This latter may in fact remain flat without penalizing the facility of penetration, for it is sufficiently tapered and pointed to be inserted without difficulty into the hingeing slit of the valves.

Similarly, the free part 3B of the end-piece is not necessarily curved in longitudinal profile. In one embodiment, the utensil of the invention may in fact comprise an end-piece whose visible part 3B has a generatrix for rectilinear leverage on the projection of the heel (see FIG. 2).

This visible part, concave or not, may be slanted upwardly with respect to the longitudinal axis of the handle or even in the axial extension thereof.

As will be understood, multiple embodiments may be envisaged, more especially in so far as the shape or the orientation of the end-piece are concerned, to the extent however that the essential features of the invention are respected, such as formulated in the main claim.

These amount in short, one the one hand, to a tapered and pointed shape of the end-piece and, on the other hand, to a relative orientation between the end-piece and the blade so that this latter slides, at least in the vicinity of the end-piece in a plane transversal to the free part 3B, i.e. in a plane passing between the base of the end-piece and its point, so that the blade may be introduced into the openings of the valves held apart by the end-piece.

Such being the case, other variations concerning different functional or constructional aspects may be used.

For example, in the case of the variation illustrated in FIG. 1, so as to reduce the depth of the housing of the compression spring, this latter may be coupled to a coaxial traction spring having the same structure but of a substantially smaller size, and which is interposed, for example, between the disk and the control wire. The same result may also be obtained, without this small spring, by means of a resilient control wire 20.

Similarly, the variation described with reference to FIG. 10, may very well be formed by means of a return spring 65 positioned in the pusher, not flat but vertically (horizontal unwinding axis).

In such a case, the pusher would have a greater height for accomodating the spring.

Similarly the return spring 65 could be housed in the rear part of the handle, as in the variation illustrated in FIG. 3, but disposed flat and at the level of passage 10, so that its unwound part, anchored in the pusher of the blade, remains not visible while remaining pressed against the base of the blank of the passage.

Generally, the feature of the invention according to which the blade is assisted by a return spring must be understood as including not only a spring, in the usual meaning of this term, namely a mechanical resiliently deformable member, but any means likely to exert and antagonistic action, resilient or not, which opposes the movement which the blade is subjected to.

A man skilled in the art will however be perfectly aware that in the present state of knowledge, a spring of the kind selected in the previously described examples represents the best adapted means for a device such as an oyster-opening utensil, according to the invention, intended for the general public.

Moreover, although this latter was designed originally for opening oysters, it is clear that its field of use extends, as already mentioned, to any other similar bivalve mollusk.

In addition, its simple and robust contruction presents no unsolved problem and provides an object adapted to mass production under quite competitive economic conditions from elements and materials commercially available at low cost.

The utensil of the invention, used in accordance with the operating method, which is closely associated therewith, allows oysters to be opened with an efficiency, safety and cleaniliness which seems at the present time still unrivalled.

If so desired, the retractable blade may be provided with two differentiated cutting edges: a main well sharpened cutting edge on the inner edge of the blade and a subsidiary blunter cutting edge on the outer edge so as to prevent any possibility of injury.

Similarly, it will be understood that the term "blade" used for describing the retractable member for cutting the muscle, must be understood in its general sense as a cutting element.

Thus, this term covers not only a blade properly speaking in the usual language, namely an elongate, flat and thin tool sharpened along one edge, but any other functional equivalent, such as a wire shaped element, capable of cutting tender flesh, such as those forming mollusks and more especially the muscles of oysters.

Moreover, it is important to emphasize that the inventors were aware that it was possible to further improve substantially the facility in cutting this muscle when, with the cutting element being a blade (taken here in its usual meaning) this latter has a slight lateral slope with respect to the horizontal so that, with the utensil seen from above, the right-hand edge of the blade is raised with respect to its left-hand edge.

This position allows in fact, during the horizontal pivoting movement intended to cut the muscle by means of the blade in the completely extended position, this movement of the blade to be made inside the oyster outwardly in the direction of the muscle while avoiding the obstacles of the internal wall of the shell.

The inventors have shown that in this respect a slope of the order of 30° with respect to the horizontal is perfectly suitable without these indications being limiting.

It remains however possible to provide a similar cutting facility, but while practicing then a larger separation of the valves, so a greater vertical rocking movement of the handle of the utensil.

The utensil of the invention may be used equally by right-handed or left-handed people.

It may be provided, as has been seen, with reliable protections which do not get in the way and which remove the least risk of injury while making other safety measures superfluous, such as the use of a protective glove for example.

The ergonomic shape of its handle provides an excellent manual grip and the simplicity of its handling, which requires not special dexterity, places it within the reach of the greatest number.

The utensil in this respect has been designed to leave a certain freedom of initiative to the operators whose handling he will adapt depending on the shape and the size of the shell he wishes to open.

The inventors have in fact desired to keep such a facility after having discovered that a typical oyster (or shellfish) having a shape and size representative of the whole of the species does not exist, at least in so far as is concerned the definition of a solution ensuring opening under the excellent conditions proper to the invention.

It is claimed:

1. An oyster-opening utensil which comprises:

a utensil body formed with an elongated utensil handle;

a pointed and tapered rigid valve-separating tongue projecting from one end of said handle and engageable in a hinge portion of an oyster to spread the valves thereof apart, said tongue being curved in a longitudinal plane of said handle and said tongue whereby said tongue can be rocked on one of said valves after insertion through said hinge portion to lift the other valve relative to said one valve;

an elongated blade slidably mounted in said handle for movement rectilinearly parallel to said plane and a longitudinal dimension of said handle and displaceable to extend from said end thereof rectilinearly along a side of said tongue toward which said tongue is curved to sever a muscle interconnecting said valves; and spring means in said handle for retracting said blade into said handle.

2. The utensil defined in claim 1 wherein said tongue is concave toward said side in cross section.

3. The utensil defined in claim 2 wherein said body further comprises a projection in an extension of said handle having a rounded end for bearing against the hand of a user of the utensil holding the oyster.

4. The utensil defined in claim 3 wherein said projection is formed by two prongs projecting laterally from said end of said handle generally in the same direction as that in which said tongue extends and flanking said tongue but spaced therefrom, said prongs being spaced apart by a distance at least equal to the width of the heel of an oyster to be opened.

5. The utensil defined in claim 1 wherein said spring means includes a spiral spring housed in a pusher sliding on said handle and connected with said blade for displacing same.

6. The utensil defined in claim 4 wherein said projection and said handle are formed unitarily with one another.

7. The utensil defined in claim 1 wherein said blade has a lateral slope with respect to the horizontal so that with the utensil seen from the rear, the right-hand edge of the blade is raised with respect to the left-hand edge of the blade.

8. The utensil defined in claim 1 wherein said blade is fork shaped with cutting edges straddling said tongue.

* * * * *